US007104426B2

(12) United States Patent
Suzuki

(10) Patent No.: US 7,104,426 B2
(45) Date of Patent: Sep. 12, 2006

(54) DISPENSING CONTAINER

(75) Inventor: Kazuo Suzuki, Koto-ku (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 321 days.

(21) Appl. No.: 10/480,530

(22) PCT Filed: Apr. 30, 2003

(86) PCT No.: PCT/JP03/05512

§ 371 (c)(1),
(2), (4) Date: Dec. 12, 2003

(87) PCT Pub. No.: WO03/093127

PCT Pub. Date: Nov. 13, 2003

(65) Prior Publication Data

US 2005/0040182 A1 Feb. 24, 2005

(30) Foreign Application Priority Data

Apr. 30, 2002 (JP) ..... 2002-128339

(51) Int. Cl.

| | |
|---|---|
| ***B65D 37/00*** | (2006.01) |
| ***B65D 35/022*** | (2006.01) |
| ***B65D 35/056*** | (2006.01) |
| ***B65D 25/04*** | (2006.01) |
| ***B67D 5/042*** | (2006.01) |

(52) U.S. Cl. ..... 222/209; 222/94; 222/105; 222/213; 222/386.5; 222/491

(58) Field of Classification Search ..... 222/94, 222/95, 131, 209, 212, 213, 481, 481.5, 484, 222/491, 386.5, 494, 105
See application file for complete search history.

(56) References Cited

U.S. PATENT DOCUMENTS

| | | | | |
|---|---|---|---|---|
| 5,529,213 | A * | 6/1996 | Mack et al. | 222/95 |
| 6,302,607 | B1 * | 10/2001 | Burrowes et al. | 401/18 |
| 6,672,479 | B1 * | 1/2004 | Shiraishi et al. | 222/105 |

FOREIGN PATENT DOCUMENTS

JP A 63-183147 7/1988

(Continued)

*Primary Examiner*—Kevin Shaver
*Assistant Examiner*—Melvin A. Cartagena
(74) *Attorney, Agent, or Firm*—Oliff & Berridge, PLC.

(57) ABSTRACT

The first and second check valve mechanisms, which are applicable to a small-size double-layered container, are created while maintaining high productivity. The discharge container provided with these check valve mechanisms comprises an outer container, which has the flexibility to make this outer container squeezable and recoverable to its original shape and which is provided with a cylindrical outer neck on top thereof. This discharge container also comprises an inner container, which is deformable with the decrease in the content and is disposed inside the outer container under the condition that cylindrical inner neck has been directly engaged with, and tightly fitted to, the outer neck. The first check valve mechanism is engaged with, and tightly fitted to, the inside of the inner neck and is used to open or close the opening of the inner neck while preventing outside air from creeping in the inner container. The second check valve mechanism is engaged with, and tightly fitted to, either one of the outer neck or the inner neck, with the lower end of this mechanism being in tight contact circumferentially with the other one of the outer neck or the inner neck, and is used to open or close airflow paths, which extends from the upper air intakes near the outer neck in a manner that allows outside air to enter the void between the outer and inner containers but does not allow air in the void to escape outside. There is thus provided a highly sanitary discharge container having high productivity and affording no entry of outside air into the inner container.

14 Claims, 5 Drawing Sheets

FOREIGN PATENT DOCUMENTS

| | | |
|---|---|---|
| JP | U 3-108650 | 11/1991 |
| JP | A 4-297264 | 10/1992 |
| JP | U 4-132051 | 12/1992 |
| JP | A 6-14972 | 1/1994 |
| JP | A 7-22951 | 1/1995 |
| JP | U 7-4351 | 1/1995 |
| JP | A 8-164954 | 6/1996 |

* cited by examiner

DISPENSING CONTAINER

TECHNICAL FIELD

This invention relates to a discharge container, such as an eyedropper, from which the content can be discharged while preventing outside air from creeping into the discharge container, especially into the inside of the inner container.

BACKGROUND OF THE INVENTION

Various small-size containers are in use to contain liquid medicines, such as eye drops, and to discharge medicines therefrom, drop by drop, by squeezing the body of the container with fingers. The body resiliently restores its original shape as soon as the pressure is released after the discharge. At that time, the container faces a problem as outside air creeps in the container along with airborne foreign matters and bacteria, which may contaminate the liquid content.

As the means of solving this problem, Japanese patent applications P1992-297264 and P1994-14972 describe a method of adding a filter inside the content discharge path. Utility model laid open No. 1988-183047 describes a method of putting restraints on the entry of outside air by giving a flat shape to the end of the container or by making the body flat and foldable so that the volume of the container will be decreased with the decrease in the content.

As another method of preventing outside air from coming in the inside of the container, utility model laid open No. 1995-22951 describes a double-layered container. A discharge cap is put to cover the opening of the container (outer container) in which to place the inner container. This cap is provided with a content discharge valve, which is able to discharge the content but does not take in outside air, and with an air suction valve, which is able to take in outside air but does not discharge air outside. Because of the action of these valves, air is introduced into the void between the inner and outer containers with the decrease in the content.

However, the method of adding a filter inside the content discharge path has problems of filter clogging or bacterial growth in the filter. The method of flattening the end of the container according to utility model laid open No. 1988-183047 is mainly an application of toothpaste tubes, and had a problem of inconvenience in use and a problem of outer appearance.

The double-layered container according to utility model laid open No. 1995-22951 has a complicated configuration. Especially, the discharge cap not only connects and fixes the outer and inner containers to each other, but also is provided with the function of an air intake valve, which is able to take in outside air and would not allow air to escape outside. In the case of small-size discharge containers such as eyedroppers, it is difficult, and not feasible in reality, for the container to have such a function while maintaining high productivity.

This invention has been made to solve the technical problems found in conventional art. The technical problem of this invention is to create feasible check valve mechanisms for use in small-size double-layered containers, while maintaining high productivity. The object of this invention is to provide a highly sanitary discharge container of a double-layered structure having high productivity and no entry of outside air into the inner container.

DISCLOSURE OF THE INVENTION

The means of carrying out the invention of Claim 1 to solve the above-described technical problem comprises the following configuration:

that the outer container has the flexibility to make this outer container squeezable and recoverable to its original shape, and is provided with a cylindrical outer neck on top thereof;

that the inner container is deformable with the decrease in the content, and is disposed inside the outer container under the condition that cylindrical inner neck has been directly engaged with, and tightly fitted to, the outer neck;

that the first check valve mechanism is engaged with, and tightly fitted to, the inside of the inner neck and is used to open or close the opening of the inner neck while preventing outside air from creeping in the inner container; and that the second check valve mechanism is engaged with, and tightly fitted to, either one of the outer neck or the inner neck, with the lower end of this mechanism being in tight contact circumferentially with the other one of the outer neck or the inner neck, and is used to open or close air flow paths extending from the upper air intakes between the inner and outer necks in a manner that allows outside air to enter the void between the outer and inner containers but does not allow air in the void to escape outside.

In the configuration of Claim 1, the outer container, the inner container, the first check valve mechanism, and the second check valve mechanism are assembled with, and tightly fitted to, one another. As a result, a void is formed between the outer and inner containers, and this void extends from the top of the neck to the bottom, and serves as the air flow path. Meanwhile, the second check valve mechanism is disposed in the void and is assembled with, and tightly fitted to, either one of the outer neck or the inner neck, with the lower end being in tight contact with the other one of the outer or inner neck. This second check valve mechanism has the action and effect as a check valve to open or close the air flow paths in a manner that allows outside air to enter the void between the outer and inner containers but does not allow air in the void to escape outside.

The content in the inner container is discharged by the squeeze of the body of the outer container. When the squeeze is stopped and the pressure is released, the discharge of the content comes to a halt. The body of the outer container begins restoring its original shape due to a resilient force. The first check valve, which has been assembled with, and tightly fitted to, the inner neck, shows the action and effect to prevent the back flow of the content and the entry of outside air into the inner container.

At that time, the inner container remains deformed as a result of a decrease in the volume of the content. Outside air is thus introduced from slits on the outer neck into the void between the outer and inner containers, while deforming the lower end of the second check valve and releasing the close contact state of this lower end. Consequently, the inner container remains deformed, but the outer container is restored to its original shape.

When the outer container is again squeezed to discharge the content after the outer container has restored its original shape, the airflow paths are blocked by the check function of the second check valve mechanism. Therefore, a pressure is applied on the content to open the first check valve mechanism and to discharge the content outside.

As described above, outside air is prevented from creeping in the inner container, and instead, air is introduced into the void between the inner and outer containers. It is thus possible to provide a container that does not impair the discharge operability of squeeze and yet prevents the content from coming in contact with outside air.

The configuration of Claim 1 comprises the outer and inner necks directly assembled with and tightly fitted to each other, the first check valve mechanism fitted to the inner neck, and the second check valve mechanism fitted to either inner or outer neck. This configuration lowers the number of parts and simplifies the container-assembling process. Even for the small containers used as eyedroppers, it has become possible to provide a double-layered container having two types of check valves, while maintaining high productivity.

The means of carrying out the invention of Claim 2 exists in the configuration that, in the invention of Claim 1, the second check valve mechanism comprises the second valve of a tapered cylindrical shape, which is suspended obliquely downward from the lower portion of the outer fitting cylinder so that the second valve can be deformed inward in a manner that the valve easily restores its original position, wherein the second check valve mechanism is assembled with, and tightly fitted to, the inner neck under the conditions that the outer fitting cylinder has been fitted tightly into the mouth portion of the inner neck and that the lower outward edge of the second valve has been in tight contact with the inner wall of the outer neck.

The configuration of Claim 2 comprises the structure of the second check valve mechanism and a method of assembling and fitting the mechanism. The overall shape of this mechanism is a tapered cylinder, which is axisymmetrical in position, has top surface, with its lower portion being suspended obliquely downward. The second check valve mechanism can be made of a soft synthetic resin or a rubber material, and can be easily molded.

The second check valve mechanism is assembled with, and tightly fitted to, the inner neck by fitting the outer fitting cylinder to the cylindrical inner neck. No circumferential positioning is required in fitting this mechanism to the inner neck. The lower portion of the second valve can also be brought to the circumferential contact with the inner wall of the outer neck with a high degree of precision. In addition, since the sealing property at the inner neck is secured, the second check valve mechanism is able to demonstrate fully the action and effect as a check valve.

In other words, the second check valve mechanism of Claim 2 can be manufactured at a low cost, and the process for assembling and fitting the same is simple. Thus, a highly reliable container can be provided at a low cost.

The means of carrying out the invention of Claim 3 exists in the configuration that, in the invention of Claim 1 or 2, the inner opening is formed by an inner ring projecting from the inner wall of the inner neck; that the first check valve mechanism comprises the first valve, which connects to an inner fitting cylinder by way of a connector; and that the first check valve mechanism is fitted tightly into the inner neck so that the first valve is able to open or close the inner opening under the conditions that the inner fitting cylinder has been assembled with, and tightly fitted to, the inner neck and that the lower end of the inner fitting cylinder has been put on the upper surface of the inner ring.

The above configuration of Claim 3 comprises the structure of the first check valve mechanism and a method of assembling and fitting the same. The first check valve mechanism is assembled and fixed by fitting an inner cylinder into the cylindrical inner neck in a manner that the lower end of the inner fitting cylinder is put in direct contact with the upper surface of the inner ring. Thus, the first check valve mechanism can be assembled and fixed easily at a right position without the need for circumferential positioning. In addition, since the seal at the inner neck is secured, the first check valve mechanism is able to demonstrate fully the action and effect as a check valve.

The means of carrying out the invention of Claim 4 exists in the configuration that, in the invention of Claim 3, a discharge section comprises an upper discharge cylinder disposed on the upper portion of a lower discharge cylinder by way of a diameter-reduced portion, from under which a flange projects laterally in the outward direction; and that the discharge section is assembled with, and tightly fitted into, the mouth portion of the inner neck under the conditions that the lower discharge cylinder is tightly fitted in the inner fitting cylinder of the first check valve mechanism and that the underside of the flange is in direct contact with the top surface of the inner neck.

Because of the above configuration of Claim 4, the inner fitting cylinder of the first check valve mechanism is sandwiched respectively by the cylindrical lower discharge cylinder and the inner neck. Furthermore, because the top surface of the lower discharge cylinder can be in contact with the downside of the flange, strong assembling and fitting, as well as sealing, is attained to give the action and effect as a highly reliable check valve.

The means of carrying out the invention of Claim 5 comprises that, in the invention of Claim 1, 2, 3, or 4, tubes are used to mold the inner and outer bodies.

Based on the configuration of Claim 5, extrusion-molded tubes are used. A neck and shoulder portion is fitted to, and integrated with, an outer tube and an inner tube by means of injection molding or compression molding. Then, the inner body is inserted into the outer body, and the other ends are closed together by such means as sealing. In this manner, a double-layered container can be made easily.

The means of carrying out the invention of Claim 6 comprises that, in the invention of Claim 1, 2, 3, 4, or 5, eye drops are the content of this double-layered container.

Because airborne bacteria and foreign matters, such as dust, can be prevented from creeping in the inside of the container, a highly sanitary and safe discharge container can be provided for use as an eyedropper.

A PREFERRED EMBODIMENT OF THE INVENTION

Figure 1:
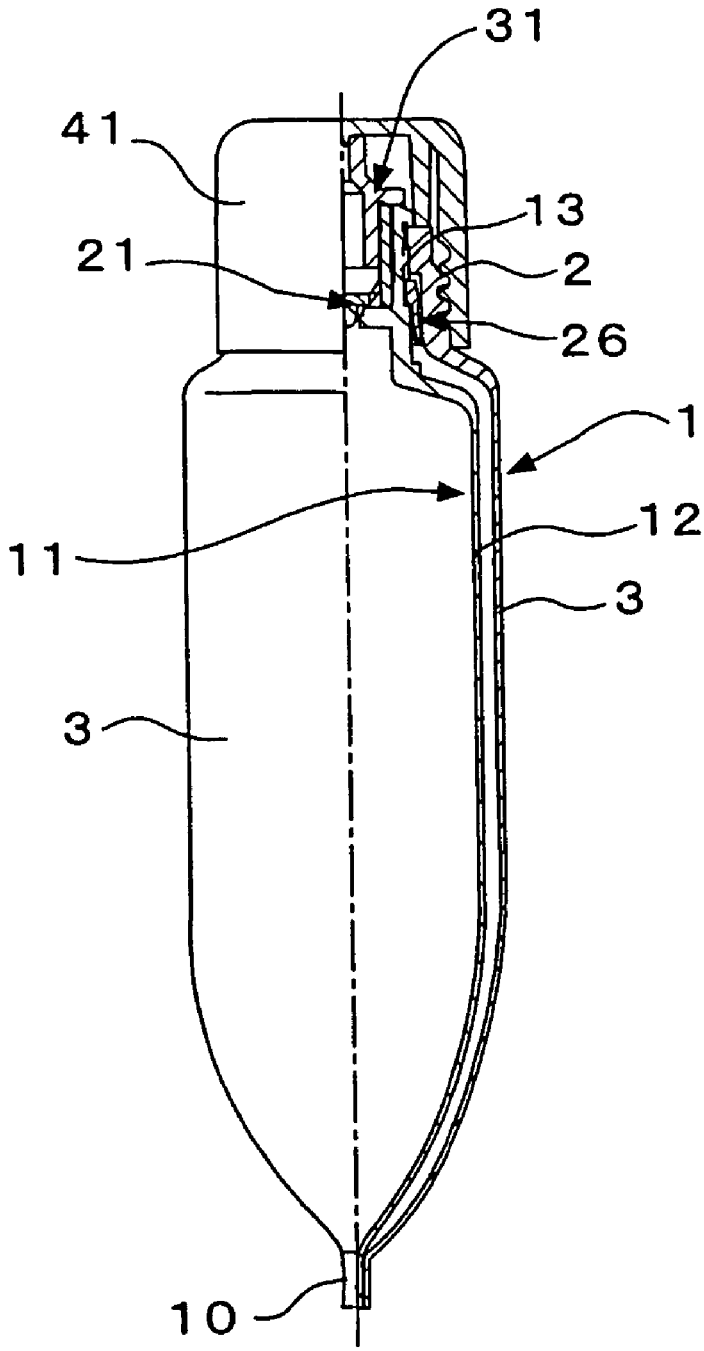
FIG. 1 is a side elevational view showing a capped discharge container in the preferred embodiment of this invention, with the right half being in longitudinal section.
Figure 2:
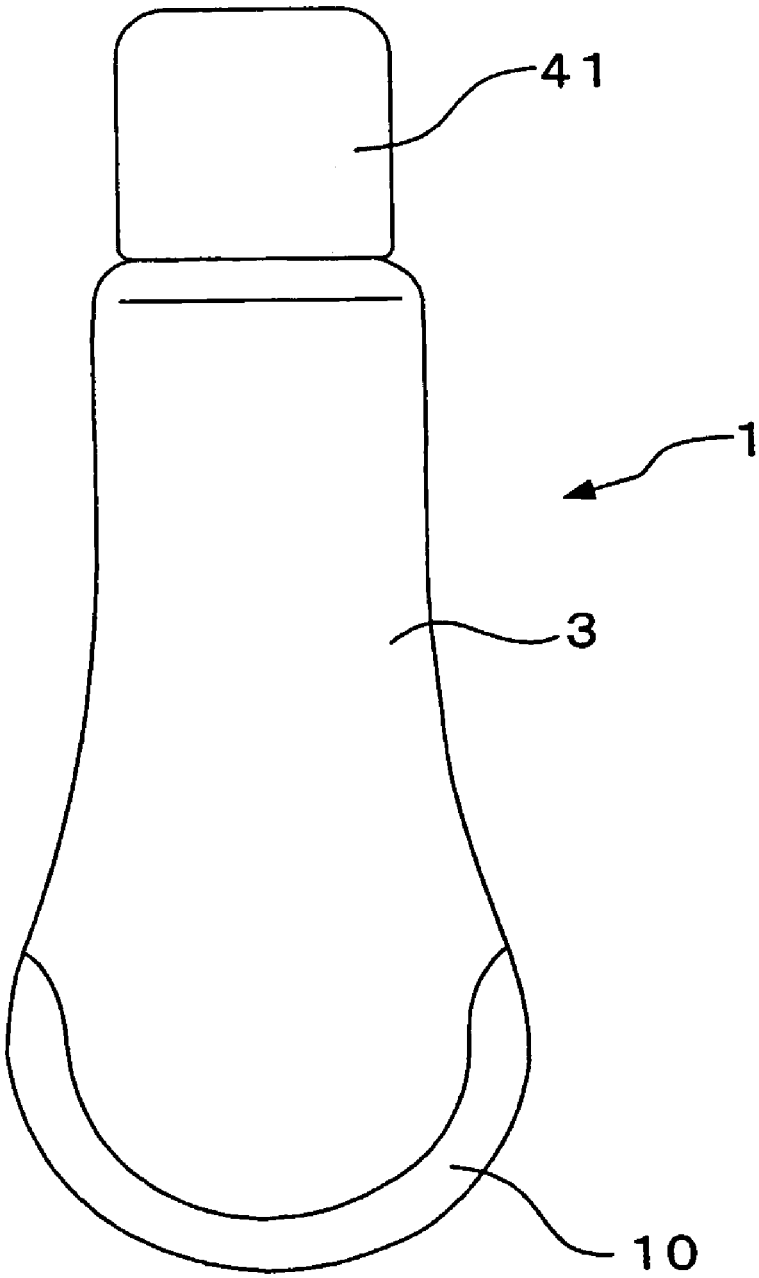
FIG. 2 is a front view of the discharge container in the preferred embodiment of this invention.

This invention is further described with respect to preferred embodiments of this invention, now referring to the drawings. FIGS. 1–5 show a discharge container in an embodiment of this invention, which comprises an outer container 1, an inner container 11, the first check valve mechanism 21, the second check valve mechanism 26, and a discharge section 31. Among them, the inner container 11 and the discharge section 31 are made of a hard synthetic resin. The first check valve mechanism 21 and the second check valve mechanism 26 are made of a soft synthetic resin or a rubber material. (Hereinafter this invention is described mainly referring to FIG. 3, which is a longitudinal section, with the most important portion being enlarged.)

The outer container 1 comprises an outer body 3 having the flexibility to make it squeezable and restorable to its original shape, and also comprises a cylindrical outer neck 2, which is provided on the upper part of the outer body 3 by way of a tapered shoulder. On the upper part of this outer neck 2 there is provided a locking projection 5, which is projected inward along the circumference of the outer neck 2 and is engaged with a locking groove 16 of a later described inner neck 13. A helical thread 2*a* is notched on the outer peripheral wall of the outer neck 2. An overhang 2*b* is formed in the inner wall at a roughly central height position. Underneath the overhang 2*b*, an empty space is secured between the outer neck 2 and the inner neck 13 to accommodate the later described second check valve mechanism 26.

The inner container 11 comprises an inner body 12, which is formed to have a thin wall so that this inner body 12 is deformable with the decrease in the volume of content, and also comprises the cylindrical inner neck 13, which is disposed on the upper part of the inner body 12 by way of a tapered shoulder. An inner ring 15 is provided circumferentially on the inner wall at a roughly central height position to form an inner opening 17. The locking groove 16 is formed in the upper part of the outer peripheral wall and is engaged with the locking projection 5 of the outer container 1. A peripheral groove 19 is provided on the outer wall at a roughly central height position. An outer fitting cylinder 27 of the second check valve mechanism 26 is assembled with, and is tightly fitted into, this groove 19. In addition, multiple air intake slits 18 (8 in number in this embodiment; see FIGS. 4 and 5) are provided, which extend from the near top area between the inner and, outer necks to the peripheral groove 19.

In this embodiment, extrusion-molded tubes are used in both of the outer container 1 and the inner container 11. A neck and shoulder portion is fitted to, and integrated with, a tube by means of injection molding or compression molding to obtain both the outer and inner containers. Then, the inner body 11 is inserted into the outer body 1, and the other ends are sealed together by forming a seal 10 (See FIGS. 1 and 2)

The first check valve mechanism 21 is made of a soft synthetic resin or a rubber material. The disc-like first valve 23 has a semispherical convex surface in the central area of the disc. The first valve 23 is connected via pieces of connectors 24 to the near lower end of the inner wall of the inner fitting cylinder 22. This cylinder 22 is assembled with, and is fitted tightly into, the inner neck 13 under the conditions that this cylinder 22 is tightly fitted to the inner wall of the inner neck 13 and that the lower end of the inner fitting cylinder 22 is in contact with the top surface of the inner ring 15. The first valve 23 acts as a check valve to open or close the inner opening 17 as the first valve 23 goes up or down, taking advantage of the flexibility and resilient recovery of the connectors 24.

The second check valve mechanism 26 is made of a soft synthetic resin or a rubber material and comprises the second valve 28 of a tapered cylinder, which is suspended obliquely downward from the lower portion of the outer fitting cylinder 27 so that the second valve 28 can be deformed inward in a manner that the valve easily restores its original position. The outer fitting cylinder 27 is tightly fitted into the peripheral groove 19 so that the second check valve mechanism 26 can be assembled with, and fitted to, the inner neck 13. At that time, because the top surface and the bottom surface of the outer fitting cylinder 27 are in contact with the peripheral groove 19, vertical positioning is carried out simultaneously.

The second check valve mechanism 26 is assembled with, and fitted to, the peripheral groove 19 in the undercut state. But since the second check valve mechanism 26 is made of a much flexible material, it can be fitted around the inner neck 13 from above and can easily be set in place.

The discharge section 31 comprises an upper discharge cylinder 34, a flange 33 of an outward brim shape, and a lower discharge cylinder 32, which is connected to the upper discharge cylinder 34 by way of a diameter-reduced portion. The lower discharge cylinder 32 is tightly fitted into the inner fitting cylinder 22, and is assembled with the upper portion of the inner neck 13 under the condition that the lower surface of the flange 33 is in contact with the top surface of the inner neck 13.

The flange 33 and the lower discharge cylinder 32 firmly set in place the first check valve mechanism 21 made of a soft material, and can be used to form an upper discharge cylinder 34 and a discharge port 35 of any shape fit for purpose.

In the state that the above-described outer container 1, the inner container 11, the first check valve mechanism 21, the second check valve mechanism 26, and the discharge section 31 have been assembled together, there are provided airflow paths 8 for the entry of outside air, which passes by the upper end of the outer neck 2, passes through the air intake slits 18 and around the second valve 18 of the second check valve mechanism 26, and reaches-the void between the outer container-1 and the inner container 11. The outer periphery of the second valve 28 is in tight contact with the inner wall of the outer neck 2 (See FIG. 5).

When the discharge container in this embodiment is not in use, it is stored with a cap 41 screwed on the outer neck 2, as shown in FIG. 1.

After all the components have been assembled and the discharge container has been filled with the content, the outer body 3 is squeezed with a hand. Under this pressure, the first valve 23 is brought upward, with the connectors 24 acting as the fulcrums, and the content passes through the first valve 23 and goes outside from the discharge port 35. As soon as the pressure is released, the discharge of the content comes to a halt. The outer body 3 begins restoring its original shape. However, because of the check valve function, the first valve 23 prevents the back flow of the content and the entry of outside air into the inner container 11.

Figure 5:
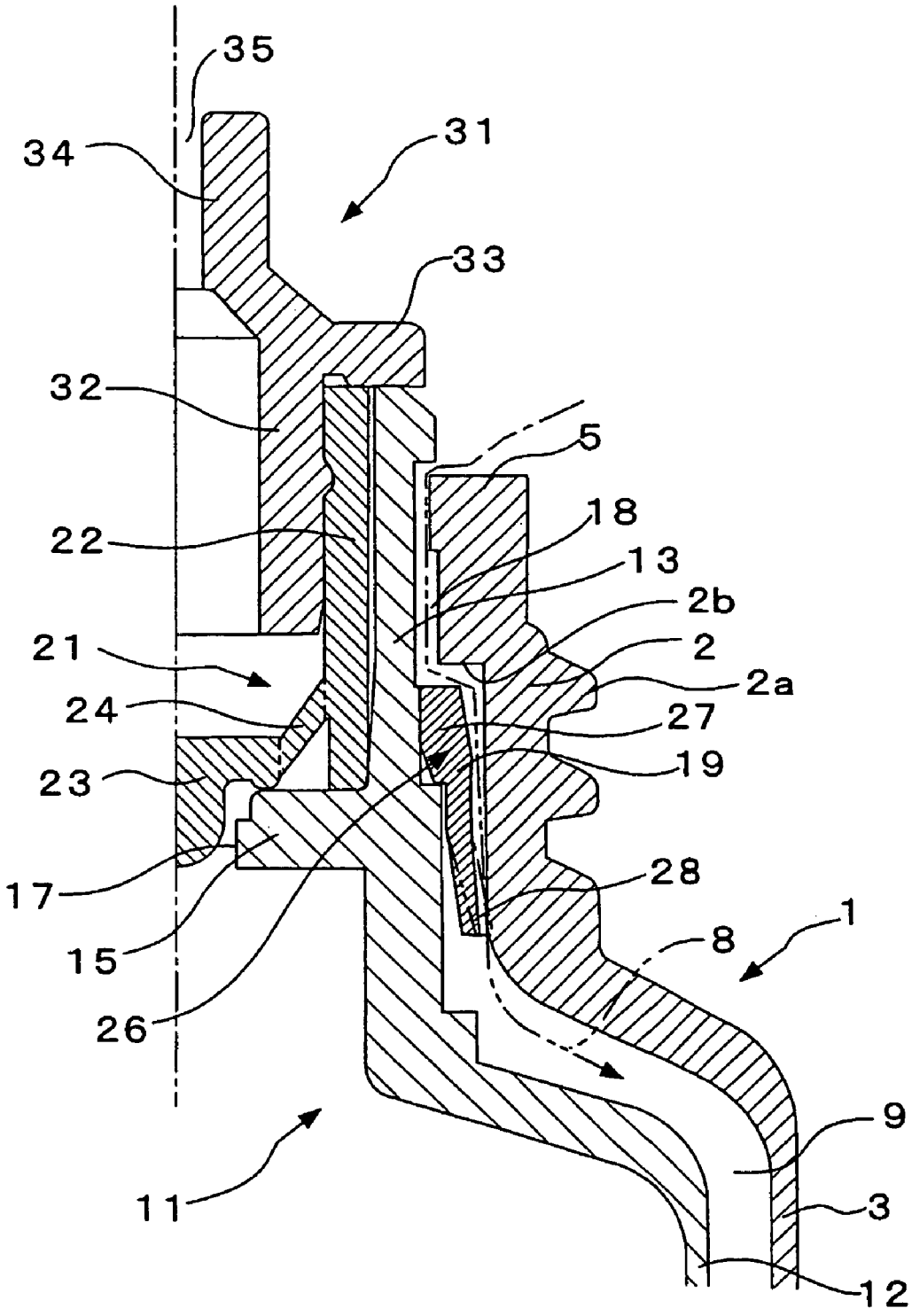
FIG. 5 is a side longitudinal section, taken from line B—B of FIG. 4, showing the enlarged important portion of the discharge container in the preferred embodiment of this invention similar to FIG. 3.

At that time, the body of the inner container 11 remains deformed as a result of a decrease in the volume of the content. Outside air is thus introduced from the air intake slits 18 into the void 9 between the outer and inner containers, while deforming the lower end of the second valve 28 inward. Consequently, the inner container remains deformed, but the outer container is restored to its original shape. In FIG. 5, an arrow accompanied by a chain double-dashed line indicates an airflow path 8, which starts at the upper part of the outer neck 2, goes down the air intake slits 18, passes around the second valve 28, and reaches the void 9.

When the outer container 3 is again squeezed to discharge the content after the outer container has restored its original shape, the connection between the air intake slits 18 and the void 9 is blocked by the check function of the second valve 28. Therefore, air in the void 9 is in a sealed state, and as a result, a pressure is applied on the content to push open the first valve 23 and to discharge the content outside through the discharge port 35.

EFFECTS OF THE INVENTION

This invention having the above-described configuration has the following effects: In the invention of Claim 1, it has become possible to provide a highly sanitary discharge container that prevents outside air from creeping in the inner container without giving any damage to the discharge operability by the squeeze.

According to this configuration, the outer neck is directly assembled with, and tightly fitted to, the inner neck. Furthermore, the first check valve mechanism is fitted into the inner neck; and the second check valve mechanism is fitted to either the inner neck or the outer neck. This configuration thus makes it possible to reduce the number of parts and to simplify the container assembling process. Even for a small-size container, such as used for eye drops, it has become possible to provide a double-layered container having two types of check valves, while maintaining high productivity.

In the invention of Claim 2, the second check valve mechanism is assembled with, and tightly fitted to, the inner neck by fitting the outer fitting cylinder to the cylindrical inner neck. No circumferential positioning is required in fitting this mechanism to the inner neck, and the action and effect as a check valve can be positively brought out.

In the invention of Claim 3, the first check valve mechanism is assembled and fixed easily at the right position by fitting an inner fitting cylinder into the cylindrical inner neck. Thus, the first check valve mechanism is able to demonstrate fully the action and effect as a check valve.

In the invention of Claim 4, the discharge section is used to secure strong assembling and fitting, as well as sealing, of the first check valve mechanism to give the action and effect as a highly reliable check valve. At the same time, the discharge section can be freely provided with an upper discharge cylinder and a discharge port of any shape fit for purpose.

In the invention of Claim 5, extrusion-molded tubes are used. A neck and shoulder portion is fitted to, and integrated with, an outer tube and an inner tube, respectively, by means of injection molding or compression molding. Then, the inner body is inserted into the outer body, and the other ends are closed together by such means as sealing. In this manner, a double-layered container can be made easily.

In the invention of Claim 6, because airborne bacteria and foreign matters, such as dust, can be prevented from creeping in the inside of the container, a highly sanitary and safe discharge container can be provided for use as an eyedropper.

The invention claimed is:

1. A discharge container comprising:

an outer container, which has the flexibility to make said container squeezable and recoverable to its original shape and is provided with a cylindrical outer neck on top thereof;

an inner container, which is deformable with the decrease in the content and is disposed inside said outer container under the condition that a cylindrical inner neck has been directly engaged and assembled with, and tightly fitted to, said outer neck;

a first check valve mechanism, which is engaged and assembled with, and tightly fitted to, the inside of said inner neck and is used to open or close the opening of said inner neck while preventing outside air from creeping in said inner container; and a second check valve mechanism, which is engaged and assembled with, and tightly fitted to, either one of said outer neck or said inner neck, with the lower end of this mechanism being in tight contact circumferentially with the other one of said outer neck or said inner neck, and which is used to open or close air flow channels passing from an upper air intakes between the inner and outer necks in such a way that allows outside air to enter a void between said outer and inner containers but does not allow air in the void to escape outside.

2. The discharge container according to claim 1, wherein said second check valve mechanism comprises a second valve of a tapered cylinder, which is suspended obliquely downward from the lower portion of an outer fitting cylinder so that said second valve can be deformed inward in a manner that the valve easily restores its original position and wherein said second check valve mechanism is assembled with, and fitted tightly to, said inner neck under the conditions that said outer fitting cylinder has been fitted tightly to the inner neck and that the lower outward edge of said second valve has been in tight contact with the inner wall of said outer neck.

3. The discharge container according to claim 2, wherein an inner opening is formed by an inner ring projecting from the inner wall of the inner neck;

wherein said first check valve mechanism comprises a first valve, which connects to an inner fitting cylinder by way of a connector; and wherein said first check valve mechanism is assembled with, and tightly fitted to, the inside of the inner neck so that said first valve is able to open or close said inner opening under the conditions that said inner fitting cylinder has been fitted tightly to the inner neck and that the lower end of said inner fitting cylinder has been put on the upper surface of said inner ring.

4. The discharge container according to claim 2, wherein tubes are used to mold the outer body and the inner body.

5. The discharge container according to claim 2, wherein the content is eye drops.

6. The discharge container according to claim 1, wherein an inner opening is formed by an inner ring projecting from the inner wall of the inner neck;

wherein said first check valve mechanism comprises a first valve, which connects to an inner fitting cylinder by way of a connector; and wherein said first check valve mechanism is assembled with, and tightly fitted to, the inside of the inner neck so that said first valve is able to open or close said inner opening under the conditions that said inner fitting cylinder has been fitted tightly to the inner neck and that the lower end of said inner fitting cylinder has been put on the upper surface of said inner ring.

7. The discharge container according to claim 6, wherein a discharge section comprises an upper discharge cylinder disposed on the upper portion of a lower discharge cylinder by way of a diameter-reduced portion, from under which a flange projects laterally in the outward direction; and wherein said discharge section is assembled with, and tightly fitted into, the mouth portion of said inner neck under the conditions that said lower discharge cylinder is tightly fitted in the inner fitting cylinder of said first check valve mechanism and that the underside of said flange is in direct contact with the top surface of said inner neck.

8. The discharge container according to claim 7, wherein tubes are used to mold the outer body and the inner body.

9. The discharge container according to claim 7, wherein the content is eye drops.

10. The discharge container according to claim 6, wherein tubes are used to mold the outer body and the inner body.

11. The discharge container according to claim 6, wherein the content is eye drops.

12. The discharge container according to claim 1, wherein tubes are used to mold the outer body and the inner body.

13. The discharge container according to claim 12, wherein the content is eye drops.

14. The discharge container according to claim 1, wherein the content is eye drops.

* * * * *

UNITED STATES PATENT AND TRADEMARK OFFICE

CERTIFICATE OF CORRECTION

PATENT NO. : 7,104,426 B2
APPLICATION NO. : 10/480530
DATED : September 12, 2006
INVENTOR(S) : Kazuo Suzuki It is certified that error appears in the above-identified patent and that said Letters Patent is hereby corrected as shown below:

Title Page,

Item [54], Title:

Change "Dispensing Container" to -- Discharge Container --

Figure 3:
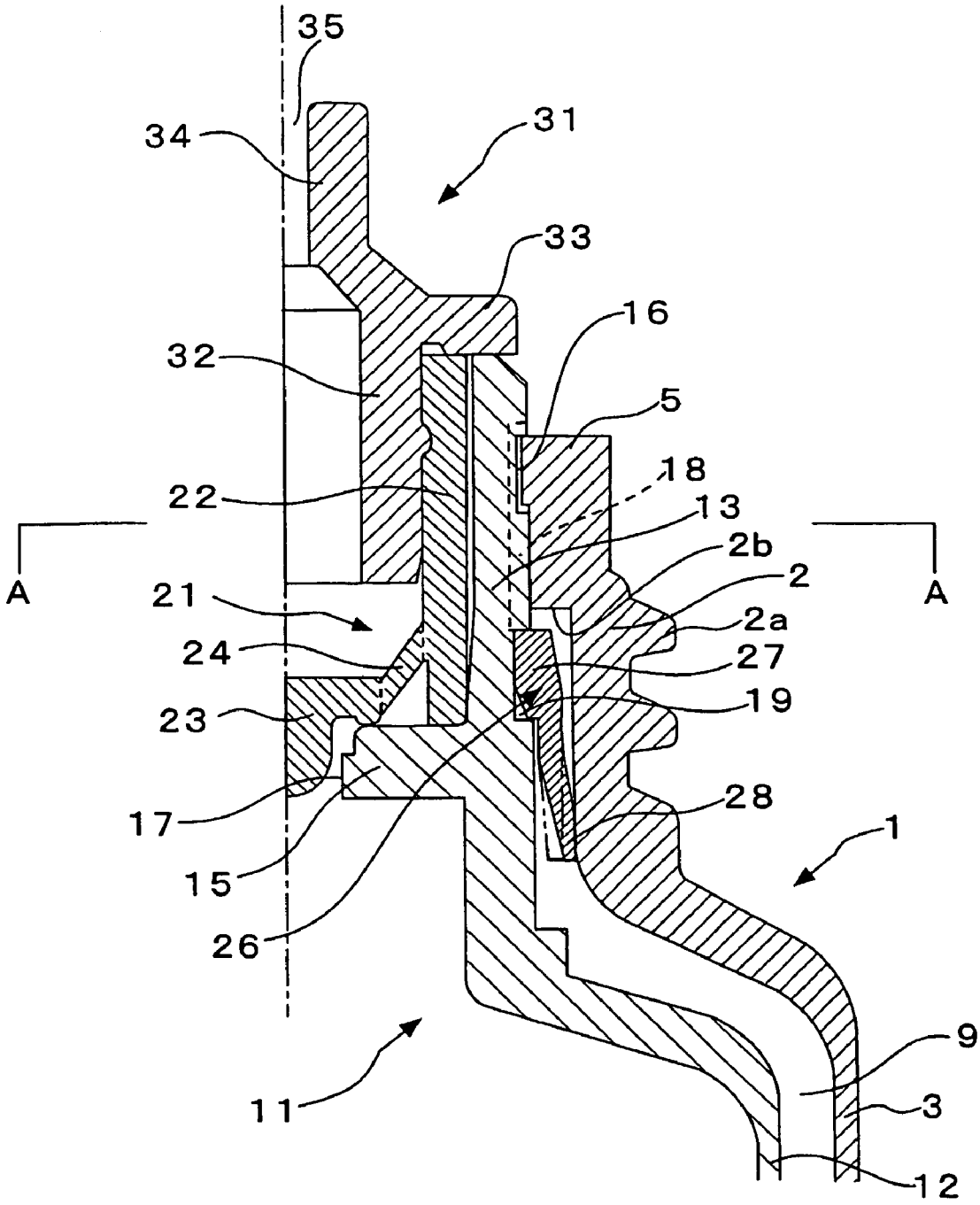
FIG. 3 is a side longitudinal section showing the enlarged important portion of the discharge container in the preferred embodiment of this invention.
Figure 4:
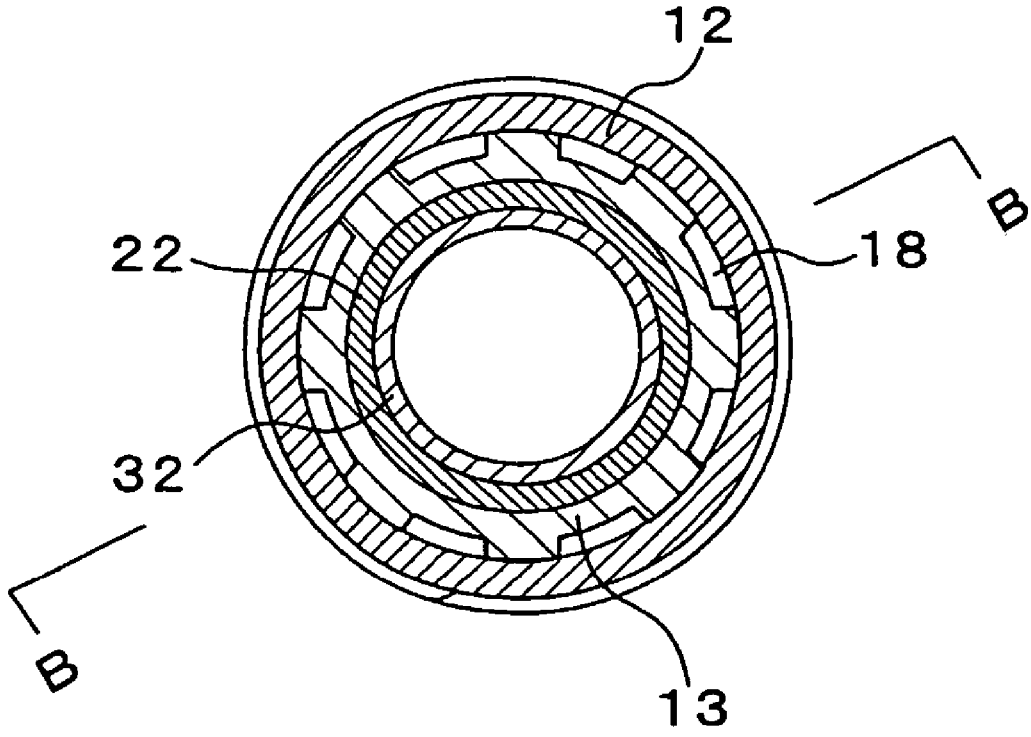
FIG. 4 is a cross-sectional plan view taken from line A—A of FIG. 3

Column 4, Line 57, change -- "A--A of FIG. 3" to --A--A of FIG. 3.--.

Column 5, Line 44, change "area between the inner and, out necks to the peripheral" to --area between the inner and outer necks to the peripheral--.

Column 5, Line 53,

Change "2)" to --2).--.

Column 6, Line 39, change "and around the second valve 18 of the second check valve" to --and around the second valve 28 of the second check valve--.

Column 6, Line 40, change -- "mechanism 26, and reaches-the void between the outer" to --mechanism 26, and reaches the void between the outer--.

Column 6, Line 41, change "container-1 and the inner container 11. The outer periphery" to --container 1 and the inner container 11. The outer periphery--.

UNITED STATES PATENT AND TRADEMARK OFFICE

CERTIFICATE OF CORRECTION

PATENT NO. : 7,104,426 B2
APPLICATION NO. : 10/480530
DATED : September 12, 2006
INVENTOR(S) : Kazuo Suzuki It is certified that error appears in the above-identified patent and that said Letters Patent is hereby corrected as shown below:

Changes to Claims,

Claim 1, Line 1, change "1. A discharge container comprising:" to --1. A discharge container, comprising:--.

Signed and Sealed this

Sixteenth Day of October, 2007

JON W. DUDAS
*Director of the United States Patent and Trademark Office*